US006979789B1

(12) United States Patent
Ma et al.

(10) Patent No.: US 6,979,789 B1
(45) Date of Patent: Dec. 27, 2005

(54) SWITCHES HAVING WETTABLE SURFACES COMPRISING A MATERIAL THAT DOES NOT FORM ALLOYS WITH A SWITCHING FLUID, AND METHOD OF MAKING SAME

(75) Inventors: Kuixiang Ma, Singapore (SG); John Ralph Lindsay, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/086,874

(22) Filed: Mar. 21, 2005

(51) Int. Cl.[7] ..... H01H 29/00
(52) U.S. Cl. ..... 200/182
(58) Field of Search ..... 200/182, 187–189, 200/209–219, 233–236; 310/328, 331, 348, 310/363; 335/4, 47, 78; 385/19

(56) References Cited

U.S. PATENT DOCUMENTS 3,018,354 A 1/1962 Pollard, Jr.
3,491,219 A 1/1970 Barlow, et al.
6,323,447 B1 * 11/2001 Kondoh et al. ..... 200/182
6,743,990 B1 * 6/2004 Wong ..... 200/182
6,759,610 B1 * 7/2004 Dove et al. ..... 200/182
6,797,901 B2 * 9/2004 Kondoh et al. ..... 200/187
6,833,520 B1 * 12/2004 Wong et al. ..... 200/182

OTHER PUBLICATIONS

A. S. Kertes, et al., "Solubility Data Series", 1986, Pergamon Press, vol. 25, Metals in Mercury, a total of 15 pages, including pp. 268, 271, 274, 277, 282, 284, 300-302, 307, 309-310, and 316.
James E. Bennett, et al., "Prevention of Bridging Failure in Mercury Switches", IEEE Transactions on Parts, Hybrids, and Packaging, vol. PHP-12, No. 4, Dec. 1976, pp. 380-387.
ASM International, "Binary Alloy Phase Diagrams", Second Editions, software version 1.0, 1996, a total of 12 prints from software.

* cited by examiner

*Primary Examiner*—Michael A. Friedhofer

(57) ABSTRACT

Disclosed is a switch having first and second mated substrates defining therebetween a number of cavities. A plurality of wettable surfaces is deposited in one or more of the cavities. A switching fluid, held within one or more of the cavities, serves to connect and disconnect at least a pair of the wettable surfaces in response to forces that are applied to the switching fluid. The wettable surfaces are formed at least in part of a material that does not form alloys with the switching fluid.

22 Claims, 3 Drawing Sheets

SWITCHES HAVING WETTABLE SURFACES COMPRISING A MATERIAL THAT DOES NOT FORM ALLOYS WITH A SWITCHING FLUID, AND METHOD OF MAKING SAME

BACKGROUND

Fluid-based switches such as liquid metal micro switches (LIMMS) comprise first and second mated substrates that define therebetween a number of cavities. Deposited within one or more of the cavities are a plurality of wettable surfaces that may be connected and disconnected by applying forces to a switching fluid. In some cases, the wettable surfaces may comprise electrodes, and the switching fluid may electrically connect and disconnect the electrodes to thereby control the propagation of electrical signals through the switch. In other cases, the switching fluid may connect and disconnect the wettable surfaces to block and unblock a plurality of windows in the cavities, thereby controlling the propagation of optical signals through the switch.

SUMMARY OF THE INVENTION

In one embodiment, a switch comprises first and second substrates, a plurality of wettable surfaces, and a switching fluid. The first and second substrates define therebetween a number of cavities. The plurality of wettable surfaces are deposited in one or more of the cavities. The switching fluid is held within one or more of the cavities and serves to connect and disconnect at least a pair of the wettable surfaces in response to forces that are applied to the switching fluid. The wettable surfaces comprise a material that does not form alloys with the switching fluid.

In another embodiment, a method for making a switch is disclosed. The method comprises: depositing a plurality of wettable surfaces on one or both of a first and second substrate, and then mating the first and second substrates to seal therebetween a switching fluid that makes contact with the wettable surfaces. The wettable surfaces comprise a material that does not form alloys with the switching fluid.

Other embodiments are also disclosed.

BRIEF DESCRIPTION OF THE DRAWINGS

Illustrative embodiments of the invention are illustrated in the drawings, in which.

DETAILED DESCRIPTION

Figure 1:
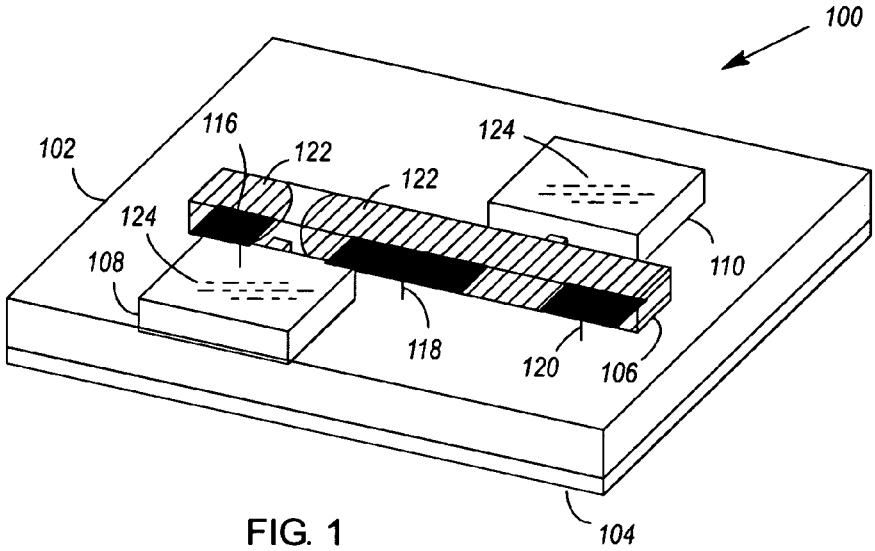
FIG. 1 illustrates a first exemplary embodiment of a fluid-based switch.
Figure 2:
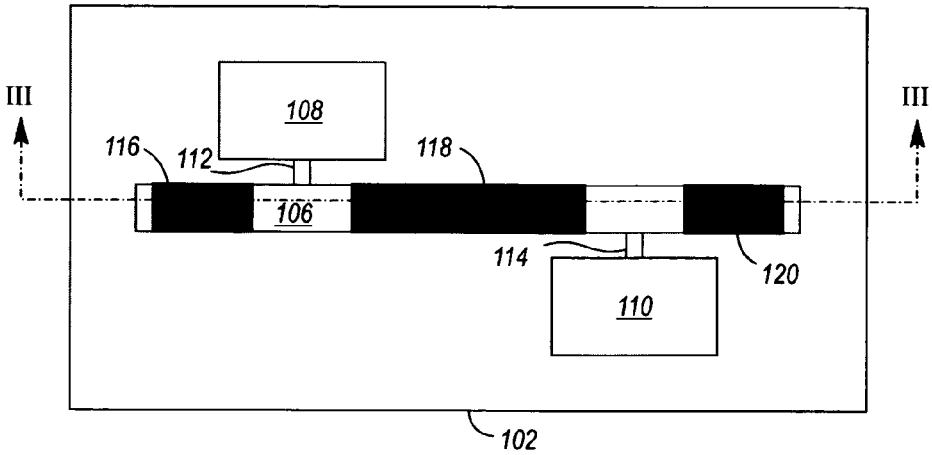
FIG. 2 illustrates a plan view of one of the substrates of the switch shown in FIG. 1.
Figure 3:
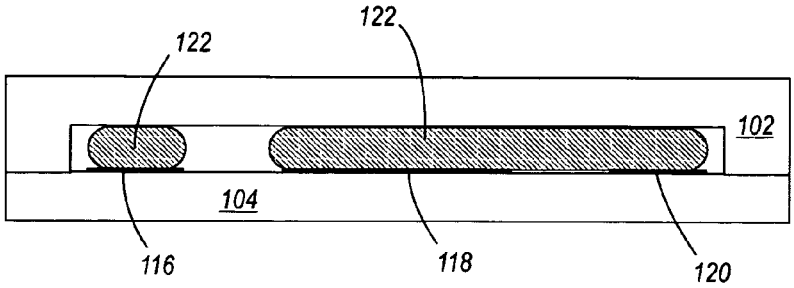
FIG. 3 illustrates a cross-section of the substrate shown in FIG. 2.

FIGS. 1–3 illustrate a first embodiment of a fluid-based switch 100. The switch 100 comprises first and second substrates 102, 104 that define therebetween a plurality of cavities 106, 108, 110, 112, 114. Deposited in one of the cavities 106 is a plurality of electrodes 116, 118, 120. Held within the same cavity 106 is a switching fluid 122 that serves to connect and disconnect different pairs 116/118, 118/120 of the electrodes in response to forces that are applied to the switching fluid 122. By way of example, the switching fluid 122 may be any conductive fluid, such as a liquid metal (e.g., mercury).

The forces applied to the switching fluid 122 result from pressure changes in an actuating fluid 124 (e.g., an inert gas or liquid) that is held in a pair of cavities 108, 110 that are connected to the switching fluid cavity 106. The actuating fluid cavities 108, 110 are connected to the switching fluid cavity 106 by means of connecting cavities 112, 114, at locations that lie between the switch's electrodes 116, 118, 120. The pressure changes in the actuating fluid 124 serve to impart pressure changes to the switching fluid 122, thereby causing the switching fluid 122 to change form, move, part, etc. In the switch state shown in FIG. 1, the pressure of the actuating fluid 124 held in a first cavity 108 applies a force to part the switching fluid 122 as illustrated. In this state, the rightmost pair of the switch's electrodes 118, 120 is coupled. If the pressure of the actuating fluid 124 held in the first cavity 108 is relieved, and the pressure of the actuating fluid 124 held in a second cavity 110 is increased, the switching fluid 122 can be forced to part and merge so that the rightmost pair of the switch's electrodes 118, 120 is decoupled, and instead, the switch's leftmost pair of electrodes 116, 118 is coupled.

By way of example, pressure changes in the actuating fluid 124 may be achieved by means of heating the actuating fluid 124, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method". The latter is described in U.S. Pat. No. 6,750,594 of Wong entitled "Piezoelectrically Actuated Liquid Metal Switch".

Although the above referenced patents disclose the movement of a switching fluid 122 by means of dual push/pull actuating fluid cavities 108, 110, a single push/pull actuating fluid cavity might suffice if significant enough push/pull pressure changes could be imparted to a switching fluid from such a cavity. Additional details concerning the construction and operation of a switch 100 such as that which is illustrated in FIGS. 1–3 may be found in the afore-mentioned patents of Kondoh et al. and Wong.

Figure 4:
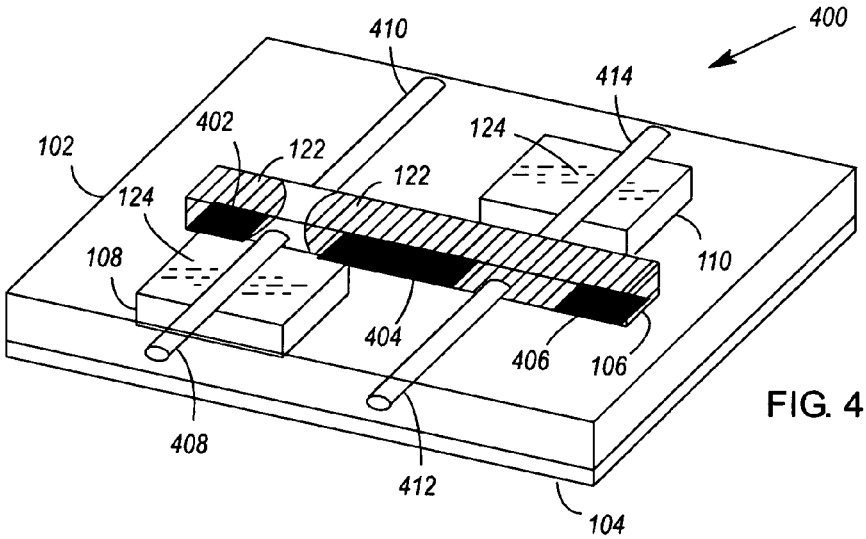
FIG. 4 illustrates a second exemplary embodiment of a fluid-based switch.

FIG. 4 illustrates a second exemplary embodiment of a fluid-based switch 400. As in the switch 100, the switch 400 comprises first and second substrates 102, 104 that define therebetween a plurality of cavities 106, 108, 110, 112, 114. Deposited in one of the cavities 106 is a plurality of wettable pads 402, 404, 406. Held within the same cavity 106 is a switching fluid 122 that serves to connect and disconnect different pairs of the wettable pads 402/404, 404/406 in response to forces that are applied to the switching fluid 122. By way of example, the switching fluid 122 may be a liquid metal (e.g., mercury).

The walls of the cavity 106 in which the switching fluid 122 resides may be translucent, or may be provided with translucent windows. The switching fluid 122 is opaque. In this manner, movements of the switching fluid 122 cause the switching fluid 122 to block and unblock a number of light paths to thereby enable or disable the propagation of optical signals through the switch 400. In one embodiment, the light paths are defined by waveguides 408, 410, 412, 414 that are aligned with translucent windows in the cavity 106 holding the switching fluid 122.

The remaining components of the switch 400 are numbered in the same manner as, and operate similarly to, their corresponding components in FIG. 1.

The fluid-based switches 100, 400 shown in FIGS. 1 & 4 are exemplary only. Other switch embodiments may comprise different combinations of wettable surfaces (e.g., electrodes or wettable pads), with the wettable surfaces and switching fluid that connects them being deposited and held within any one or more of a number of cavities. The cavities may be those shown in FIGS. 1 & 4, or may be other cavities of varying depths and widths. It is also noted that the switching fluid may take other forms, most notable of which are: a mercury alloy, gallium or gallium alloy, or potassium sodium.

Figure 5:
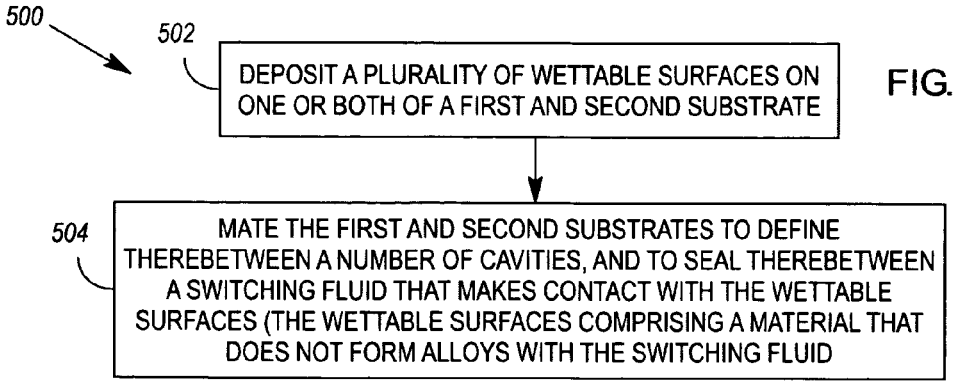
FIG. 5 illustrates a method for making a fluid-based switch.

FIG. 5 illustrates a method 500 for making a switch such as either of those shown in FIGS. 1 & 4. The method 500 comprises first depositing 502 a plurality of wettable surfaces on one or both of a first and second substrate, and then mating 504 the first and second substrates to 1) define therebetween a number of cavities, and 2) seal therebetween a switching fluid that makes contact with the wettable surfaces.

When a switching fluid 122 comes into contact with wettable surfaces (e.g., 116, 118, 120), a variety of physiochemical reactions can occur at the solid-liquid interface, even at room temperature. These reactions include dissolution of the wettable surfaces 116–120 into the switching fluid 122, the formation of alloys (e.g., amalgams) between the wettable surfaces 116–120 and switching fluid 122, and the formation of intermetallics in the switching fluid 122. These reactions can be detrimental and can deteriorate the structure and electrical properties of the wettable surfaces 116–120, thereby decreasing the switch's performance, reliability and longevity.

In some cases, the above reactions can change the physical properties of the fluids 122, 124 (e.g., increase the volume of a switch's metals and fluids (where, for instance, a platinum electrode forms the amalgam $HgPt_4$), increase the viscosity of a fluid, or decrease the surface tension of a fluid). Furthermore, these physical changes can be slow, such that they are not appreciable until well after a switch is manufactured. Thus, they can cause mechanical stresses inside a switch, leading to poor operation or even breakage. They can also result in "leakage" paths or "tunnels" beside and over conductive runners that extend near a switch's switching fluid cavity 106. The reactions can also effect the resistivity and wettability of the wettable surfaces 116–120.

To mitigate or eliminate some or all of the above reactions, the wettable surfaces 116–120 may comprise a material that does not form alloys with the switching fluid 122 (i.e., a material that has no detectable phases with the switching fluid 122). In some embodiments, the wettable surfaces 116–120 may consist solely of the material that does not form alloys with the switching fluid 122. In other cases, the wettable surfaces 116–120 may consist essentially of the material that does not form alloys with the switching fluid 122. In yet other cases, the wettable surfaces 116–120 may comprise both a material that does not form alloys with the switching fluid 122, in combination with a material that does form alloys with the switching fluid 122. In one embodiment, the material that does form alloys with the switching fluid 122 is selected as a result of its having a conductivity that is greater than that of the material that does not form alloys with the switching fluid 122.

Consider now a fluid-based switch wherein its switching fluid comprises mercury. Materials that do not form alloys (i.e., amalgams) with mercury comprise iridium (Ir), osmium (Os), ruthenium (Ru), rhenium (Re), cobalt (Co), iron (Fe), molybdenum (Mo), tungsten (W), chromium (Cr), niobium (Nb), tantalum (Ta), and vanadium (V), either alone or in combination.

The selection of which of a number of materials should be used to form a wettable surface may depend on a variety of factors. One factor that can be important in selecting the material for a wettable surface is its solubility in a particular switching fluid. That is, if a wettable surface has a low solubility in a particular switching fluid, the likelihood (or at least rate) of the wettable surface dissolving into the switching fluid will be mitigated. Preferably, the wettable surface has a solubility in the switching fluid of less than or equal to about $10^{-6}$% by atomic ratio (i.e. less than or equal to about one-millionth of one percent) at about room temperature. In switches having a mercury switching fluid, wettable surfaces comprising iridium have been found to perform best from a solubility standpoint.

Low solubility can be important not only from a longevity standpoint, but from a cost standpoint. That is, if a wettable surface is unlikely to dissolve into a switch's switching fluid, it is sometimes possible to deposit a thinner layer of the material when forming the wettable surface (i.e., since less or none of it will dissolve into the switching fluid).

Another factor that can be important in selecting the material for a wettable surface is its Standard Gibbs energy of formation (which is sometimes referred to herein as its "oxidation energy"). That is, its oxidation energy should be great enough to ensure that it will not oxidize during manufacture of a switch. If a switch can be manufactured in an oxygen-free environment, oxidation energy may be less important. However, it is sometimes difficult to maintain an oxygen-free manufacturing environment.

The Standard Gibbs energies of formation for some of the above "amalgam-less" materials (i.e., materials that do not form amalgams with mercury) are as follows:

Iridium: about −200 kJ/mole $O_2$
Osmium: about −240 kJ/mole $O_2$
Ruthenium: about −250 kJ/mole $O_2$
Rhenium: about −380 kJ/mole $O_2$
Cobalt: about −430 kJ/mole $O_2$
Iron: about −500 kJ/mole $O_2$ Although iron may have a suitable oxidation energy under some manufacturing conditions, those materials having an oxidation energy of greater than or equal to about −430 kJ/mole $O_2$ have been found to perform better in environments where oxygen is present. Iron tends to rust too easily. Those materials having an oxidation energy of greater than or equal to about −250 kJ/mole $O_2$ have been found to perform significantly better, and those with an oxidation energy of greater than or equal to about −200 kJ/mole $O_2$ (i.e., iridium) have been found to be the best performers.

In the case of electrical switches, yet another factor that can be important in selecting the material for a wettable surface (i.e., an electrode) is its conductivity. In this regard, a material that does not form a stable oxide (if and when oxidation does occur) can also be important. Lack of a stable oxide can also be important in maintaining a surface's wettability.

For mercury-based switches, a material that performs well in the context of all of the above factors is iridium. Iridium does not form amalgams with Mercury, has low solubility in mercury, has a high oxidation energy (i.e., an oxidation that is less negative), and has good conductivity. Also, and because its oxidation energy is high, it does not form stable oxides, thereby causing it to maintain good wettability by liquid metals (such as mercury) at temperatures up to 250° C.

As previously indicated, a wettable surface may sometimes comprise a material that does not form an alloy with a switching fluid, as well as a material that does form an alloy with the switching fluid. In the case of a mercury-based switch, platinum is one material that it may be desirable to combine with an amalgam-less material (i.e., because of its high conductivity and unstable oxide).

Figure 6:
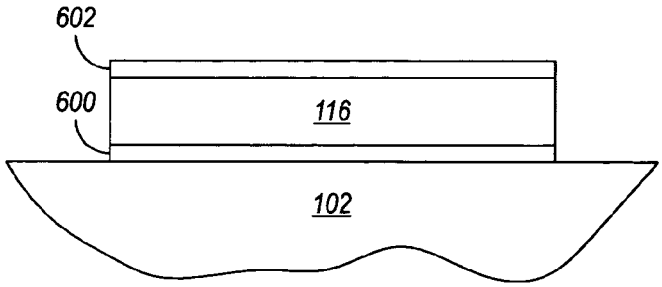
FIG. 6 illustrates a wettable surface of the switch shown in FIG. 1, wherein the wettable surface is bounded by an adhesion layer and a cap layer.

By way of example and not limitation, the substrate (or substrates) on which wettable surfaces may be deposited may be formed of glass, ceramics, metals or polymers. Depending on a substrate's composition, as well as its cleanliness and stability, it is sometimes desirable to deposit an adhesion layer 600 to the substrate 102 prior to depositing a wettable surface 116. See FIG. 6. Materials that have been found to perform well as adhesion layers for the substrates and wettable surfaces disclosed herein comprise tantalum, chromium, and titanium.

Note that, in some cases, a wettable surface may offer greater wettability if it is prepared by means of argon plasma cleaning, heating or both.

Given that oxides on a wettable surface can interfere with both its conductivity and wettability, in environments where oxygen contamination is likely, or when the material used for a wettable surface has a low oxidation energy, it is sometimes desirable to cover the wettable surface 116 with a cap layer 602 which is selected so as to mitigate oxidation of the wettable surface 116. See FIG. 6.

One material that works well as a cap layer 602 is gold. If a very thin layer of gold is deposited on a wettable surface 116, and the switching fluid 122 which is ultimately deposited on the wettable surface 116 is mercury, the thin gold layer will entirely dissolve into the mercury. As the thickness of the gold layer is increased, it may still tend to dissolve into the mercury, with little or no amalgam formation. In some cases, however, the gold layer may be thick enough that it forms amalgams on the wettable surface 116. These amalgams may be an acceptable trade-off given the oxide mitigating properties of gold.

Figure 7:
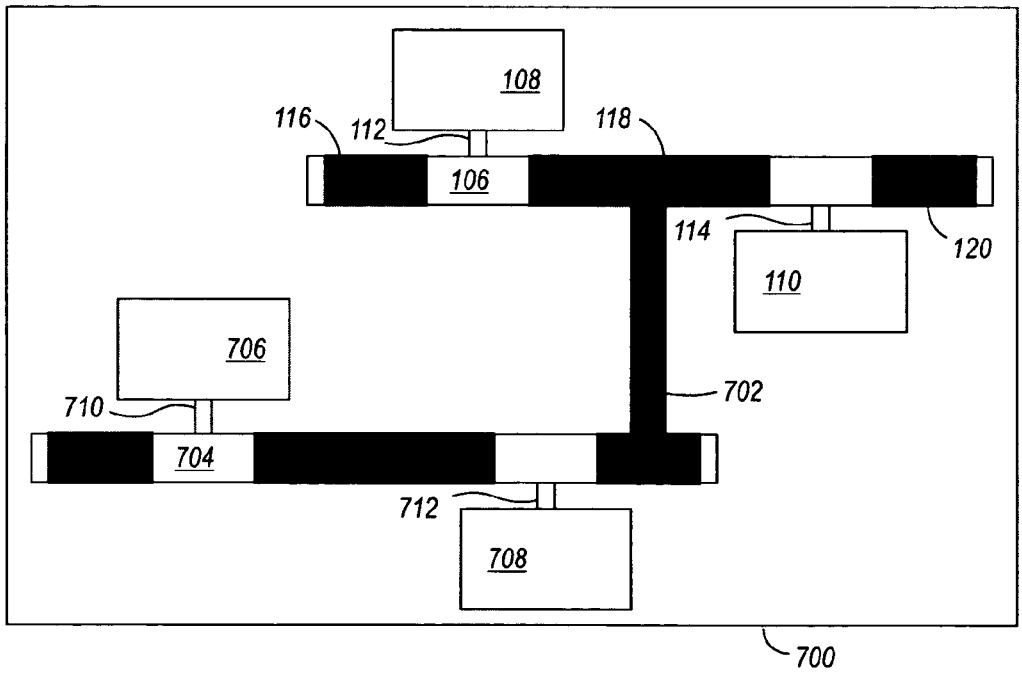
FIG. 7 illustrates a conductive runner extending between the switching fluid cavities of first and second fluid-based switches.

In some cases, the material used to form a wettable surface may form part of a conductive runner 702 that extends from within to outside of the switching fluid cavity 106 of a switch. For example, FIG. 7 illustrates a substrate 700 having channels 106–114, 704–712 therein belonging to two different switches, with a conductive runner 702 extending between and into the switching fluid cavities 106, 704 of each switch. If the conductive runner 702 is formed of a material that does not form alloys with the switching fluids of the two switches, then any leakage of switching fluid will not deteriorate the runner 702.

In addition to using "alloy-less" or "amalgam-less" runners 702 to connect two fluid-based switches, such a runner 702 could also be used to couple a switch to another circuit element (e.g., a resistor, capacitor, contact pad, etc.).

What is claimed is:

1. A switch, comprising:

first and second mated substrates defining therebetween a number of cavities;

a plurality of wettable surfaces deposited in one or more of the cavities; and a switching fluid, held within one or more of the cavities, that serves to connect and disconnect at least a pair of the wettable surfaces in response to forces that are applied to the switching fluid;

wherein the wettable surfaces comprise a material that does not form alloys with the switching fluid.

2. The switch of claim 1, wherein the switching fluid comprises mercury or a mercury alloy, and wherein the material that does not form alloys with the switching fluid has a solubility in mercury of less than or equal to about $10^{-6}$% by atomic ratio at about room temperature.

3. The switch of claim 1, wherein the switching fluid comprises mercury or a mercury alloy, and wherein the material that does not form alloys with the switching fluid has a Standard Gibbs energy of formation greater than or equal to about −430 kJ/mole $O_2$.

4. The switch of claim 1, wherein the switching fluid comprises mercury or a mercury alloy, and wherein the material that does not form alloys with the switching fluid has a Standard Gibbs energy of formation of greater than or equal to about −250 kJ/mole $O_2$.

5. The switch of claim 1, wherein the switching fluid comprises mercury or a mercury alloy, and wherein the material that does not form alloys with the switching fluid has a Standard Gibbs energy of formation of greater than or equal to about −200 kJ/mole $O_2$.

6. The switch of claim 1, wherein the switching fluid comprises mercury or a mercury alloy, and wherein the material that does not form alloys with the switching fluid has a solubility in mercury of less than about $10^{-6}$% by atomic ratio at about room temperature and a Standard Gibbs energy of formation of greater than or equal to about −200 kJ/mole $O_2$.

7. The switch of claim 1, wherein the material that does not form alloys with the switching fluid comprises iridium.

8. The switch of claim 7, wherein the switching fluid comprises mercury or a mercury alloy.

9. The switch of claim 1, wherein the switching fluid comprises gallium, a gallium alloy, or potassium sodium.

10. The switch of claim 1, further comprising at least one adhesion layer, deposited in the one or more cavities defined by the first and second substrates, to adhere the wettable surfaces to one or both of the substrates.

11. The switch of claim 10, wherein the at least one adhesion layer comprises tantalum, chromium, or titanium.

12. The switch of claim 1, further comprising at least one cap layer, deposited on the wettable surfaces, to mitigate oxidation of the wettable surfaces.

13. The switch of claim 12, wherein the at least one cap layer has a higher solubility in the switching fluid than do the wettable surfaces.

14. The switch of claim 12, wherein the at least one cap layer comprises gold.

15. The switch of claim 1, wherein at least one of the wettable surfaces forms part of a conductive runner that extends from within to outside of the number of cavities defined between the first and second substrates.

16. The switch of claim 15, wherein the first and second substrates further define therebetween a second number of cavities, and wherein the conductive runner extends into at least one of the second number of cavities.

17. The switch of claim 1, wherein the wettable surfaces consist essentially of the material that does not form alloys with the switching fluid.

18. The switch of claim 1, wherein the wettable surfaces further comprise a material that does form alloys with the switching fluid, but which has a conductivity greater than that of the material that does not form alloys with the switching fluid.

19. The switch of claim 18, wherein the switching fluid comprises mercury, and wherein the material that does form alloys with the switching fluid comprises platinum.

20. The switch of claim 1, wherein the switching fluid comprises mercury, and wherein the material that does not form alloys with the switching fluid does not form amalgams with mercury.

21. A method for making a switch, comprising:

depositing a plurality of wettable surfaces on one or both of a first and second substrate; and mating the first and second substrates to define therebetween a number of cavities, and to seal therebetween a switching fluid that makes contact with the wettable surfaces;

wherein the wettable surfaces comprise a material that does not form alloys with the switching fluid.

22. The method of claim 21, further comprising, before mating the first and second substrates, depositing at least one cap layer on the wettable surfaces, the at least one cap layer serving to mitigate oxidation of the wettable surfaces in the absence of contact with the switching fluid.

* * * * *